US005528726A

United States Patent [19]

Cook

[11] Patent Number: 5,528,726

[45] Date of Patent: Jun. 18, 1996

[54] DIGITAL WAVEGUIDE SPEECH SYNTHESIS SYSTEM AND METHOD

[75] Inventor: Perry R. Cook, Palo Alto, Calif.

[73] Assignee: The Board of Trustees of the Leland Stanford Junior University, Stanford, Calif.

[21] Appl. No.: 436,083

[22] Filed: May 8, 1995

Related U.S. Application Data

[63] Continuation of Ser. No. 184,757, Jan. 19, 1994, abandoned, which is a continuation of Ser. No. 825,931, Jan. 27, 1992, abandoned.

[51] Int. Cl.[6] ..... G10L 9/00

[52] U.S. Cl. ..... 395/2.7; 395/2.76

[58] Field of Search ..... 395/2, 2.1, 2.4, 395/2.67–2.78, 2.64; 381/51–53, 41

[56] References Cited

U.S. PATENT DOCUMENTS

| | | | |
|---|---|---|---|
| 3,542,955 | 11/1970 | Flanagan | 395/2.7 |
| 3,786,188 | 1/1974 | Allen | 395/2.72 |
| 4,586,193 | 4/1986 | Seiler et al. | 395/2.7 |
| 4,984,276 | 1/1991 | Smith | 381/63 |
| 5,097,511 | 3/1992 | Suda et al. | 381/51 |

FOREIGN PATENT DOCUMENTS

| | | | |
|---|---|---|---|
| 1-219899 | 9/1989 | Japan | 381/51 |
| 3-10300 | 1/1991 | Japan | 381/51 |
| 4-98298 | 3/1992 | Japan | 381/51 |

OTHER PUBLICATIONS

T. W. Parsons, *Voice And Speech Processing*, McGraw–Hill, New York, NY, 1987, pp. 100–135 and 277–280.

Fant, *Speech Sounds And Features*, MIT Press, Cambridge, MA (1973) pp. 3–16.

*Primary Examiner*—Allen R. MacDonald

*Assistant Examiner*—Michael A. Sartori

*Attorney, Agent, or Firm*—Flehr, Hohbach, Test, Albritton & Herbert

[57] ABSTRACT

A speech synthesizer uses a digital waveguide network to simulate operation of the human pharynx on acoustic signals. One end of the digital waveguide network is connected to a glottal signal source, and another end has a signal filter simulating operation of the acoustic interface at a person's lips. The digital waveguide network has sets of waveguide sections connected in series by junctions, each waveguide section including two digital delay lines running parallel to each other for propagating signals in opposite directions. Each waveguide junction has associated reflection and propagation coefficients. A parameter library that stores sets of glottal source and waveguide junction control parameters for generating corresponding sets of predefined speech signals. The waveguide junction control parameters cause the digital waveguide network to simulate operation of an acoustic tube with a shape corresponding to that of a human pharynx while producing predefined speech sounds. An articulation controller operates the glottal signal source and the digital waveguide network using a sequence of selected sets of said control parameters, thereby causing the synthesizer to generate a specified sequence of speech signals. In a preferred embodiment, the digital waveguide network has three interconnected network branches for simulating operation of the lower pharynx, the oropharynx and the nasopharynx. To generate speech signals corresponding to fricative consonants, the speech synthesizer has noise signal injectors positioned at various points along the digital waveguide network.

16 Claims, 5 Drawing Sheets

DIGITAL WAVEGUIDE SPEECH SYNTHESIS SYSTEM AND METHOD

This is a continuation of application Ser. No. 08/184,757, filed Jan. 19, 1994, now abandoned; which is a continuation of Ser. No. 07/825,931, filed Jan. 27, 1992, now abandoned.

The present invention relates generally to artificial speech synthesis systems and methods and particularly to a speech synthesis method using digital waveguides to model the acoustic mechanisms that produce human speech.

BACKGROUND OF THE INVENTION

The present invention is an extension of the technology disclosed in U.S. Pat. No. 4,984,276, which teaches the use of digital processors having digital waveguide networks for digital reverberation and for synthesis of musical sounds such as those associated with reed and string instruments.

The present invention falls into the class of synthesizers sometimes known as source/filter models because such synthesizers take into account the acoustic mechanisms that produce speech. In particular, the present invention provides a practical mechanism for explicitly modeling the shape of the vocal tract. Speech synthesis is accomplished by filtering glottal source signals with a set of digital waveguides set up to represent the time varying shape of the vocal tract associated with a specified output speech signal (such as a specified set of spoken words).

SUMMARY OF THE INVENTION

In summary, the present invention is a speech synthesizer which uses a digital waveguide network to simulate operation of the human pharynx on acoustic signals. The speech synthesizer implements a physical model that mimics the way speech sounds are generated by humans. One end of the digital waveguide network is connected to a glottal signal source, and another end has a signal filter simulating operation of the acoustic interface at a person's lips. The digital waveguide network has sets of waveguide sections connected in series by junctions, each waveguide section including two digital delay lines running parallel to each other for propagating signals in opposite directions. Each junction connected between waveguide sections has associated reflection and propagation coefficients for controlling reflection and propagation of signals in the waveguide sections connected to that junction.

The speech synthesizer has a parameter library that stores sets of control parameters for generating corresponding sets of predefined speech signals. Each set of control parameters includes waveguide junction control parameters and glottal signal source control parameters. The waveguide junction control parameters cause said digital waveguide network to simulate operation of an acoustic tube with a shape corresponding to that of a human pharynx while producing predefined speech sounds.

An articulation controller operates the glottal signal source and the digital waveguide network using a sequence of selected sets of said control parameters, thereby causing the synthesizer to generate a specified sequence of speech signals.

In a preferred embodiment, the digital waveguide network has three network branches coupled together by a three-way junction, with one network branch simulating operation of the lower pharynx and terminating at the glottal signal source, a second network branch simulating operation of the oropharynx and terminating at a lip filter, and a third network branch simulating operation of the nasopharynx and terminating at a nasal filter.

To generate speech signals corresponding to fricative consonants, the speech synthesizer has a plurality of noise signal injectors positioned at various points along the digital waveguide network.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
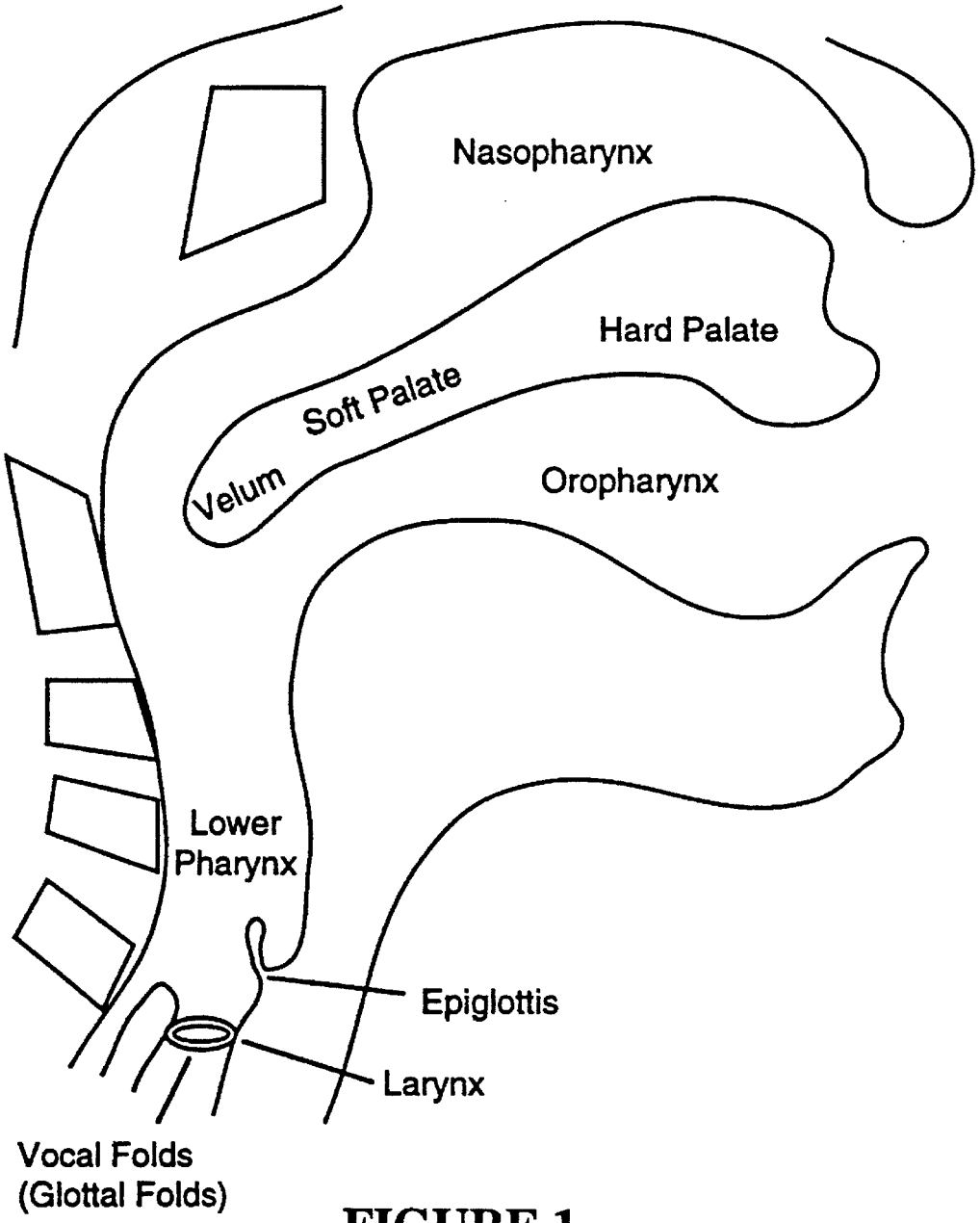
FIG. 1 schematically depicts a midsagittal cross-section of a human head, with the acoustically important features labeled.
Figure 2:
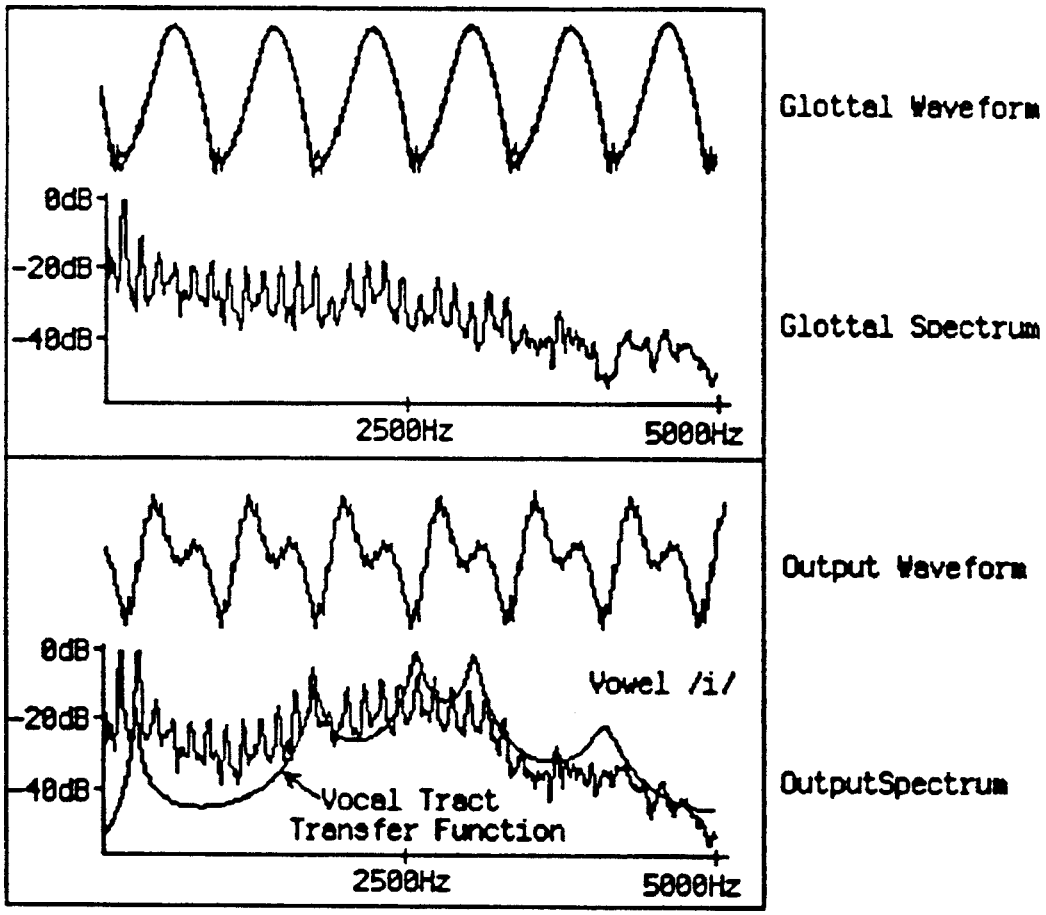
FIG. 2 shows time and frequency domain plots of a glottal waveform, and the corresponding output speech waveform and spectrum.

The voice or speech synthesis method of the present invention takes into account the acoustic mechanisms which produce the "speech signal" (i.e., human speech). In voice phonation, the glottal folds open and close roughly periodically, producing a pulsed excitation signal. The acoustic tube of the lower pharynx (herein defined as the portion of the pharynx between the glottal folds and the velum), oropharynx and the naso-pharynx form a resonant system which filters the glottal pulse, shaping the spectrum of the audible sound signal that is generated. FIG. 1 shows a midsagittal cross-section of a human head, with the acoustically important features labeled. FIG. 2 shows time and frequency domain plots of a typically glottal waveform, the filter function of the vocal tract, and the resulting output speech waveform and spectrum.

Before considering the digital waveguide used in the preferred embodiment for speech synthesis, two preliminary topics will be addressed: (A) digital waveguide simulation of an acoustic tube, and (B) the operation of an N-way junction between digital waveguides.

Digital Waveguide Simulation of Acoustic Tube

A basic component of the present invention is the use of digital waveguides to generate signals that simulate the propagation of acoustic waves in an acoustic tube. As will be described later, the preferred embodiment of the present invention incorporates three digital waveguides networks to simulate operation of the pharynx, nasopharynx and oropharynx.

Figure 3A:
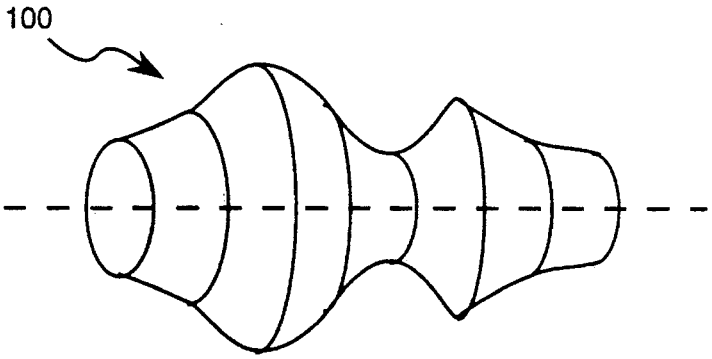
FIGS. 3A and 3B represent a smooth acoustic tube and a sampled version of the same tube.
Figure 3B:
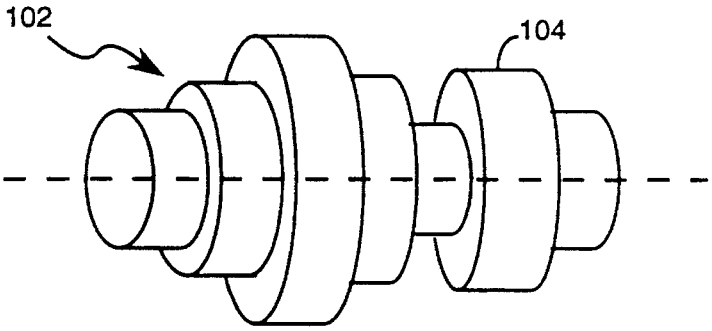
Figure 4A:
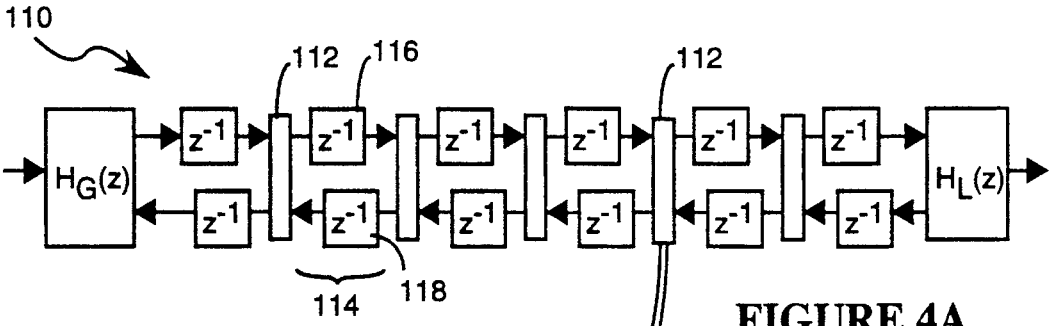
FIGS. 4A and 4B represent a digital filter which simulates an acoustic tube, and the digital scattering junction used in the digital filter.
Figure 4B:
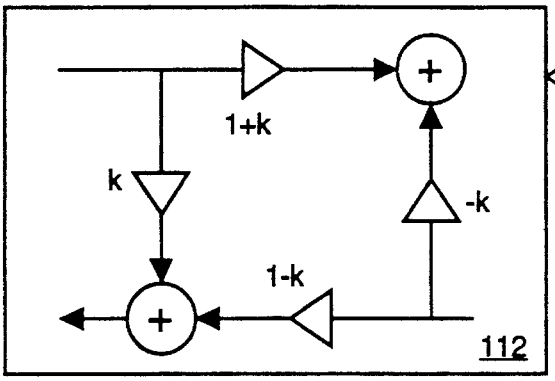

FIG. 3A shows a smooth acoustic tube 100 which varies in diameter along its length, representing part of a vocal tract, and FIG. 3B shows an acoustic tube 102 which is a digital version of the tube 100 in FIG. 3A. In FIG. 3B each section 104 of the tube 102 has the same length, and thus the same propagation time for acoustic waves. The junctions between sections of the tube cause forward and back scattering. FIG. 4A shows a digital filter (i.e., digital waveguide) circuit 110 which simulates the operation of the acoustic tube in FIG. 3B by generating electrical signals that are equivalent to the sound waves traveling through an acoustic tube. FIG. 4B represents one scattering junction 112 between adjacent waveguide sections 114. Each section 114 of the digital version of the acoustic tube is represented by two delay elements 116 and 118, one for forward moving waves and one for backward moving waves, plus a scattering junction 114 connecting it to the next adjacent tube section. In order to use a set of digital waveguides to generate sounds that would be similar to sounds generated through the use of an acoustic tube, one must first develop mathematic equations representing the acoustic waves traveling through an acoustic tube.

Each section 104 of the acoustic tube 102 is treated as a one dimensional system of transmission lines, yielding closed-form mathematical solutions to the wave equation for acoustic waves. As will be seen later, the wave equation solutions are easily simulated using digital waveguide filters, and provide the framework for controlling a vocal tract filter from physical measurements.

The starting point equations are those for conservation of momentum and mass:

$$a(x)\ \frac{\partial P(x,t)}{\partial x} = -\rho\frac{\partial U(x,t)}{\partial t}$$

$$\frac{\partial U(x,t)}{\partial x} = -\frac{a(x)}{c^2}\ \frac{\partial P(x,t)}{\partial t}$$

where a(x) is the cross-sectional area of the tube at position x, ρ is the density of air, P(x,t) is the pressure at point x at time t, c is the velocity of sound in air, and U(x,t) is the volume velocity past point x at time t. From these equations can be derived Webster's horn equation:

$$\frac{\partial}{\partial x}\left[\frac{1}{a}(x)\frac{\partial U(x,t)}{\partial x}\right] = \frac{1}{c^2 a(x)}\ \frac{\partial^2 U(x,t)}{\partial^2 t}$$

When the cross-sectional area a(x) is constant within a section m of the acoustic tube, that is $a_m(x)=a_m$, then Webster's horn equation reduces to the wave equation within each section of the tube:

$$\frac{\partial^2 U_m(x,t)}{\partial x^2} = \frac{1}{c^2}\ \frac{\partial^2 U_m(x,t)}{\partial t^2}$$

The equivalent pressure expression is:

$$\frac{\partial^2 P_m(x,t)}{\partial x^2} = \frac{1}{c^2}\ \frac{\partial^2 P_m(x,t)}{\partial t^2} \qquad \text{(Eq. 5)}$$

The solution of Equation 5 can be expressed as a decomposition of left and right-going traveling pressure waves:

$$P_m(x,t) = P_m^+\left(t-\frac{x}{c}\right) + P_m^-\left(t+\frac{x}{c}\right) \qquad \text{(Eq. 6)}$$

where $P^+_m$ and $P^-_m$ are the right and left-going pressure wave components, respectively.

To relate pressure to velocity directly, the following expression is used:

$$\left[\frac{\partial P_m^+}{\partial x} + \frac{\partial P_m^-}{\partial x}\right] = \frac{\rho c}{a_m}\left[\frac{\partial U_m^+}{\partial x} + \frac{\partial U_m^-}{\partial x}\right] \qquad \text{(Eq. 7)}$$

Next, we define characteristic impedance of the mth tube section, $R_m$, as $$R_m \equiv \frac{\rho c}{a_m} \qquad \text{(Eq. 7)}$$

By integrating both sides and ignoring any constant terms as acoustically unimportant components, the following expressions are derived to relate pressure to velocity in each tube section:

$$[P_m^+ + P_m^-] = R_m[U_m^+ - U_m^-]$$

$$P_m^+ = R_m U_m^+$$

$$P_m^- = -R_m U_m^-$$

Whenever two sections of acoustic tubing having different characteristic impedance (i.e., different diameter) meet, the boundary conditions to be satisfied are conservation of mass and momentum. Conservation of mass requires conservation of mass flow, and thus volumetric flow, assuming incompressibility. Conservation of momentum requires that pressure is continuous at the junction between the two sections of acoustic tubing. These two conditions yield the following junction scattering relations:

$$P_1^- = \frac{R_2-R_1}{R_2+R_1}\ P_1^+ + \left(1-\frac{R_2-R_1}{R_2+R_1}\right)P_2^-$$

$$P_2^+ = \left(1+\frac{R_2-R_1}{R_2+R_1}\right)P_1^+ - \frac{R_2-R_1}{R_2+R_1}\ P_2^-$$

By defining the junction scattering coefficient $k_m$ of the interface between the mth and m+ 1th sections as the following ratio of characteristic impedance values:

$$k_m = \frac{R_{m+1}-R_m}{R_{m+1}+R_m}$$

the scattering relations for pressure and velocity can be written compactly as:

$$P_m^- = k_m P_m^+ + (1-k_m)P_{m+1}^-$$
$$P_{m+1}^+ = (1+k_m)P_m^+ - k_m P_{m+1}^-$$
$$U_m^- = k_m U_m^+ + (1+k_m)U_{m+1}^-$$
$$U_{m+1}^+ = (1+k_m)U_m^+ - k_m U_{m+1}^-$$

For representation of a tube by a digital filter, the tube is divided into a number of sections 104 (as shown in FIGS. 3A and 3B), each of the same length. The section length is determined by the signal sampling rate $F_s$ used when measuring acoustic signals and the speed of sound c as:

$$\text{SectionLength}=c/F_s$$

This yields a uniform delay through each section of the tube, equal to the time required for sound waves to propagate through each section during one time sampling period.

Since the characteristic impedance of each tube section is a function of its cross-sectional area, and thus the radius, the junction scattering coefficients for the digital waveguide network are can be computed entirely from physical tract section measurements, using the above scattering relation equations and the scattering junction model of FIG. 4B. For instance, the shape of a human pharynx can be determined using X-ray and fast MIR imaging techniques while a person is speaking. Pharynx shape can also be determined using signal processing techniques, as will be discussed below.

Block $H_G(z)$ in FIG. 4A represents the transmission and reflection characteristics of the glottis. The reflection characteristic of the glottis can be simply modeled as a constant positive reflection coefficient (less than or equal to 1):

$$P^+ \text{ from glottis filter} = \text{Glottis Excitation Signal} + kP^-$$

or more elaborately as a time varying filter.

Block $H_L(z)$ in FIG. 4A represents the transmission and reflection characteristics of the lip, which vary with the configuration of the vocal tract. The transmission and reflection functions should be complementary, so that in a lossless system any energy not reflected at the lips is transmitted. A simple model of the lip reflection filter is a low-order low-pass filter, representing the loading of the end of the tube with a piston of air. The cutoff frequency is linearly related to the diameter of the tube end.

An alternate method of representing the acoustic tube wave equations using the independent variables of pressure and volume velocity is the following transmission matrix equation:

$$\begin{bmatrix} P_{i-1} \\ U_{i-1} \end{bmatrix} = \begin{bmatrix} \alpha_i \beta_i \\ \gamma_i \delta_i \end{bmatrix} \begin{bmatrix} P_i \\ U_i \end{bmatrix}$$

Based on the boundary conditions for a uniform tube, the transmission coefficients are:

$$\alpha = \cos\left(\frac{wl}{c}\right)$$

$$\beta = i\frac{\rho c}{a}\sin\left(\frac{wl}{c}\right)$$

$$\gamma = i\frac{a}{\rho c}\sin\left(\frac{wl}{c}\right)$$

$$\delta = \cos\left(\frac{wl}{c}\right)$$

where I is the length of each tube section. The transmission matrix made up from these coefficients always has a determinant of 1, which expresses the fact that in a lossless acoustic tube, power, the product of pressure and velocity, is conserved across each junction.

N-way Junctions Between Multiple Waveguides

Figure 5:
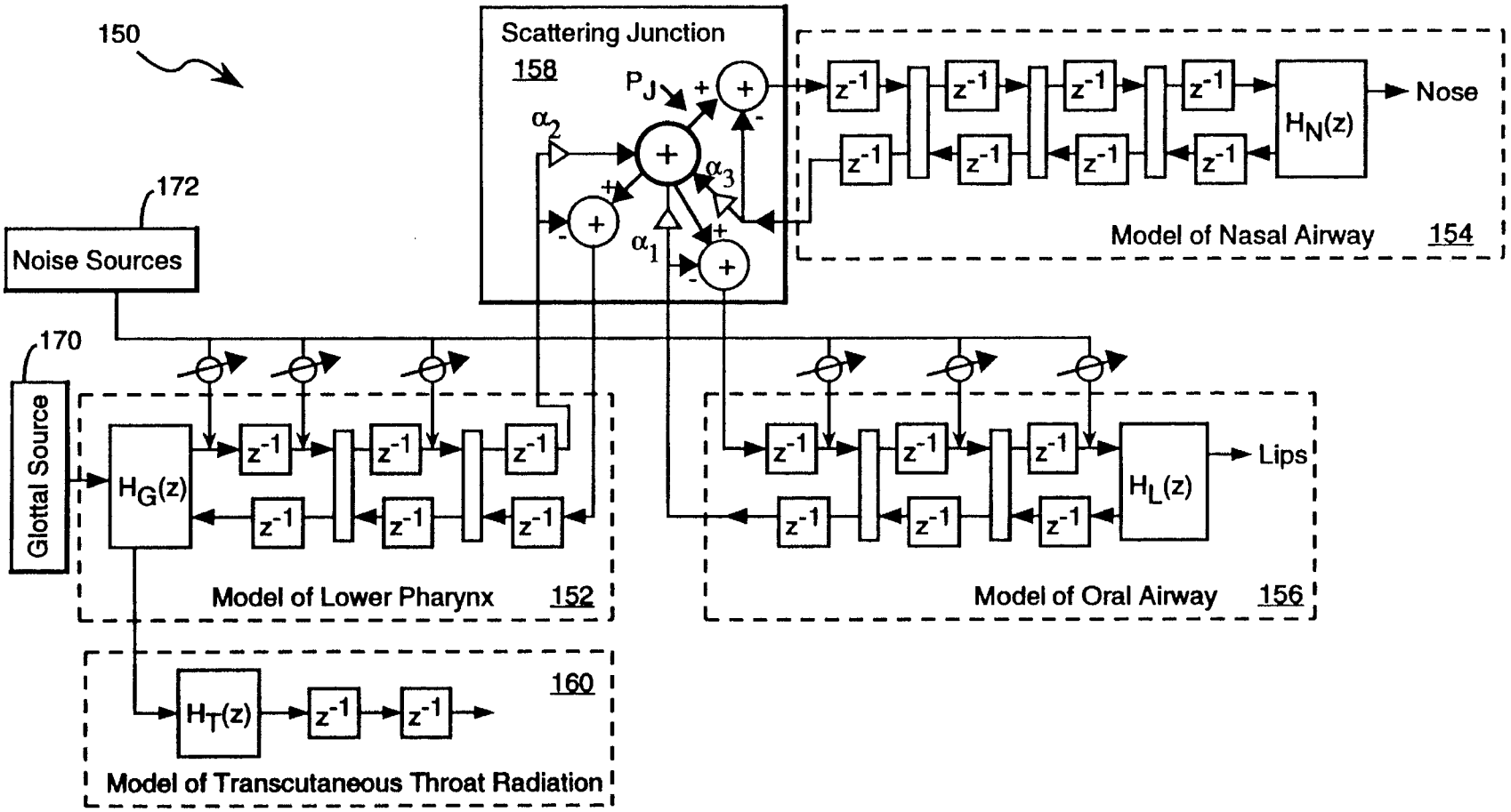
FIG. 5 is a block diagram representing a speech synthesizer using a set of three digital filters joined with a three-way scattering junction, plus an additional low-pass filter and delay line to model radiation of sound through the throat wall.

Referring to FIG. 5, the preferred embodiment of the invention uses a digital waveguide network 150 having three digital waveguide sections 152, 154, 156 coupled together by a three-way scattering junction 158. The boundary conditions of pressure continuity and flow conservation determine the relationship between pressure and volume velocity at the junction of any number of acoustic tubes (as well as for any number of interconnected digital waveguide sections used to simulate such acoustic tubes). Given a junction where n tubes meet, there are n incoming waves whose values are known, and n outgoing waves to be calculated. From the viewpoint of the junction, we will denote the incoming pressure and velocity waves from tube i as $P^+_i$ and $U^+_i$, and the outgoing waves to tube i as $P^-_i$ and $U^-_i$. Pressure and velocity are related by:

$$P^+_m = R_m U^+_m$$

$$P^-_m = -R_m U^-_m$$

The boundary conditions are:

$$P_1 = P_2 = P_3 = \ldots = P_n = P_J$$

$$U_1 + U_2 + U_3 + \ldots + U_n = O$$

where $P_J$ is the junction pressure. Next, we define the characteristic admittance of the ith tube section as the inverse of its characteristic impedance:

$$\Gamma_i = \frac{1}{R_i} = \frac{a_i}{\rho c}$$

It can be shown that:

$$P_J = \frac{2\sum_{i=1}^{n} \Gamma_i P_i^+}{\sum_{i=1}^{n}} \Gamma_i = \sum_{i=1}^{n} \alpha_i P_i^+$$

where $$\alpha_i = \frac{2\Gamma_i}{\sum_{i=1}^{n} \Gamma_i} \quad [0.2]$$

Since all the tube pressures $P_i$ at the junction are equal (to $P_J$) and $P_i = P^+_i + P^-_i$ for all tube sections i, the reflected pressure in any tube is simply the difference between the incoming pressure from that tube and the junction pressure $P_J$:

$$P^-_i = P_J - P^+_i$$

The reflected volume velocity is given by the product of the characteristic impedance of the tube and the reflected pressure.

Vocal Tract Digital Waveguide with Velum Junction

The bifurcation in the vocal tract that exists at the velum is modelled in the preferred embodiment as the three way junction 158 shown in FIG. 5. At the velum location, some of the wave energy coming from the glottis is diverted into the nasal airway, some continues on to the lips, and the rest will reflect back to the glottis. $H_N(z)$ is the reflection/transmission filter for the nose, which is fixed under normal speech and singing conditions. The reflection function at the nostrils is well modeled by a fixed cutoff low-pass filter.

Extra tubes could be added to the digital waveguides of FIG. 5 to model the space below the tongue.

Transcutaneous Throat Radiation

A small but significant amount of acoustic energy is radiated from the vocal mechanism through the throat wall. This is especially important in cases of voiced plosives and other times when all other paths out of the vocal tract are closed. The digital filter realization of the vocal tract shown in FIG. 5 includes a digital waveguide circuit 160 comprising a low-pass filter labeled $H_T(z)$ and delay line to model radiation of sound through the throat wall.

Periodic Glottal Source

The speech synthesizer of the present invention includes a glottal signal source 170 which generates excitation signals that closely mimic those generated by the vocal folds in humans. In the human vocal system the energy source is a pulsed signal generated by the opening and closing of the vocal folds. The folds open quite slowly as pushed open by the subglottal pressure, and are rapidly "sucked" closed by the Bemoulli effect resulting from air flow. This generates a quasi-periodic voice source with a spectrum that rolls off roughly exponentially with frequency. The "filter" in the human vocal system, which is controlled by the shape of the vocal tract, does not contain all the spectral information of the final output speech signal, but rather the spectral features are distributed between the source and the filter.

Based on research by the inventor and others, the present invention synthesizes the glottal pulse as a raised cosine waveshape until a specified closing edge starting point, then as a line segment from the cosine curve down to zero at the closing edge end point, and then zero for the remainder of the period. The glottal pulse is represented or controlled by parameters representing the closing edge beginning and ending points, with fixed opening slope and time. If the glottal closure beginning and ending points ($e_1$ and $e_2$, respectively) are specified as a fraction of the period of the raised cosine waveshape, the form for the frequency-normalized continuous-time parametric glottal pulse is:

$$x(t)=\begin{cases} 0.5(1-\cos(2\pi f) & t<e_1 \\ -0.5\dfrac{1-\cos(2\pi e_1)}{(e_2-e_1)}(t-e_2) & e_1 \leqq t \leqq e_2 \\ 0.0 & t>e_2 \end{cases}$$

where $0.0 \leqq e_1 \leqq e_2 \leqq 1.0$.

To control the bandwidth of the pulse to prevent aliasing, to compress the representation of the glottal pulse to a small number of parameters, and to provide some spectral parameterization for further processing, the glottal pulse can be converted into a Fourier series, represented as a sum of sinusoids:

$$x(t)=C_0+\sum_{n=1}^{\infty} A_n\cos(2\pi F_0 nt)+B_n\sin(2\pi F_0 nt)$$

where $F_o$ is the fundamental frequency, which is the inverse of the fundamental period $T_o$. In the case of a glottal pulse having a cosine portion and a line segment portion the Fourier coefficients for each portion are computed separately. For the cosine portion of the glottal pulse, the coefficients are defined as:

$$C_0=\frac{1}{T_0}\int_{t=0}^{\theta_1} x(t)dt$$

$$A_n=\frac{2}{T_0}\int_{t=0}^{\theta_1} x(t)\cos(2\pi nt)dt$$

$$B_n=\frac{2}{T_0}\int_{t=0}^{\theta_1} x(t)\sin(2\pi nt)dt$$

For the sloping line segment portion, the Fourier coefficients are computed for the line segment alone:

$$C_0^{closure}=\frac{1}{T_0}\int_{t=\theta_1}^{\theta_2} x(t)dt$$

$$A_n^{closure}=\frac{2}{T_0}\int_{t=\theta_1}^{\theta_2} x(t)\cos(2\pi nt)dt$$

$$B_n^{closure}=\frac{2}{T_0}\int_{t=\theta_1}^{\theta_2} x(t)\sin(2\pi nt)\mathrm{d}t$$

The final closed form for computing the Fourier coefficients for the parametric glottal pulse is:

$$C_0=\begin{cases} \dfrac{e_1}{2}-\dfrac{\sin(2\pi e_1)}{4\pi} & e_1=e_2 \\ \dfrac{e_1}{2}-\dfrac{\sin(2\pi e_1)}{4\pi}+\dfrac{(1-\cos(2\pi e_1))(e_2-e_1)}{4} & e_1<e_2 \end{cases}$$

$$A_{n=1}=\begin{cases} \dfrac{\sin(2\pi e_1)}{2\pi}-\dfrac{\sin(4\pi e_1)}{8\pi}-\dfrac{e_1}{2} & n=1,\ e_1=e_2 \\ \dfrac{\sin(2\pi e_1)}{2\pi}-\dfrac{\sin(4\pi e_1)}{8\pi}-\dfrac{e_1}{2}+ & \\ \left(\dfrac{(1-\cos(2\pi e_1)}{2\pi}\right)\left(\dfrac{\cos(2\pi e_1)-\cos(2\pi e_2)}{2\pi(e_2-e_1)}-\sin(2\pi e_1)\right) & n=1,\ e_1<e_2 \end{cases}$$

$$A_{n\neq 1}=\begin{cases} \dfrac{1}{2\pi}\left(\dfrac{\sin(2\pi n e_1)}{n}-\dfrac{\sin((n-1)2\pi e_1)}{2(n-1)}-\dfrac{\sin((n+1)2\pi e_1)}{2(n+1)}\right) & n>1,\ e_1=e_2 \\ \dfrac{1}{2\pi}\left(\dfrac{\sin(2\pi n e_1)}{n}-\dfrac{\sin((n-1)2\pi e_1)}{2(n-1)}-\dfrac{\sin((n+1)2\pi e_1)}{2(n+1)}\right)+ & \\ \left(\dfrac{(1-\cos(2\pi e_1)}{n}\right)\left(\dfrac{\cos(2\pi n e_1)-\cos(2\pi n e_2)}{2\pi n(e_2-e_1)}-\sin(2\pi n e_1)\right) & n>1,\ e_1<e_2 \end{cases}$$

$$B_{n=1}=\begin{cases} \dfrac{3+\cos(4\pi e_1)}{8\pi}-\dfrac{\cos(2\pi e_1)}{2\pi} & n=1,\ e_1=e_2 \\ \dfrac{3+\cos(4\pi e_1)}{8\pi}-\dfrac{\cos(2\pi e_1)}{2\pi}+\cos(2\pi e_1)+ & \\ \left(\dfrac{(1-\cos(2\pi e_1)}{2\pi}\right)\left(\dfrac{\sin(2\pi e_1)-\sin(2\pi e_2)}{2\pi(e_2-e_1)}\right) & n=1,\ e_1<e_2 \end{cases}$$

-continued $$B_{n\neq 1}=\begin{cases}\frac{1}{2\pi}\left(\frac{1-\cos(2\pi n e_1)}{n}+\frac{\cos((n-1)2\pi e_1)-1}{2(n-1)}+\frac{\cos((n+1)2\pi e_1)-1}{2(n+1)}\right) & n>1,\ e_1=e_2\\ \frac{1}{2\pi}\left(\frac{1-\cos(2\pi n e_1)}{n}+\frac{\cos((n-1)2\pi e_1)-1}{2(n-1)}+\frac{\cos((n+1)2\pi e_1)-1}{2(n+1)}\right)+ & \\ \left(\frac{(1-\cos(2\pi e_1)}{n}\right)\left(\frac{\sin(2\pi n e_1)-\sin(2\pi n e_2)}{2\pi n(e_2-e_1)}+\cos(2\pi n e_1)\right) & n>1,\ e_1<e_2\end{cases}$$

Once the Fourier coefficients are computed, the waveform of a single cycle of the glottal pulse may be synthesized digitally by sampling the Fourier series formula at the appropriate sampling rate. Other features of the glottal pulse could also be added to the Fourier series representation, providing closed form relationships between the time-domain parameters for the glottal pulse and the frequency spectrum of the resultant pulse.

For the purposes of speech synthesis by rule, the Fourier series representation of the glottal pulse is very advantageous because it allows direct manipulation of the frequency components of the signal. The parametric Fourier coefficients can be modified in specific regions to produce specific changes in the synthesized speech in a way that is directly perceptible to the human ear.

Typically, for masons of economy and real time synthesis, periodic waveforms such as the glottal pulse are stored in wave tables. To minimize quantization effect, the wavetable is synthesized using the entire dynamic range available, and the gain control is applied by multiplying the output of the wave table during re-synthesis. If one period of the wave is stored in the wave table, the wave table "length" is N, the time increment between steps in the wave table is $\delta$ (a floating point number), the desired fundamental frequency is $F_o$, and the sampling frequency is $F_s$, the increment $\delta$ is given by:

$$\delta=\frac{NF_0}{F_s}$$

yielding an output wave x(n) whose nth sample is the element from the table whose location is $n\delta$-mN where m is the greatest integer yielding a non-negative location value.

The selection of the wave table size is based on memory and distortion considerations. Aliasing occurs if the highest frequency harmonic is not sampled at a rate which is above the Nyquist frequency (at least twice the frequency of the harmonic). This is determined by the wavetable length, sampling frequency, and playback frequency. If one period of the wave form is stored in the wave table, the aliasing constrain results in the requirement that N (the table length) be greater than two times the maximum number of harmonics. The sampling frequency and fundamental frequency determine the maximum number of harmonics:

$$\text{Maximum number of harmonics} < F_s/2F_0.$$

Sources of Noise in the Vocal Tract

Figure 6:
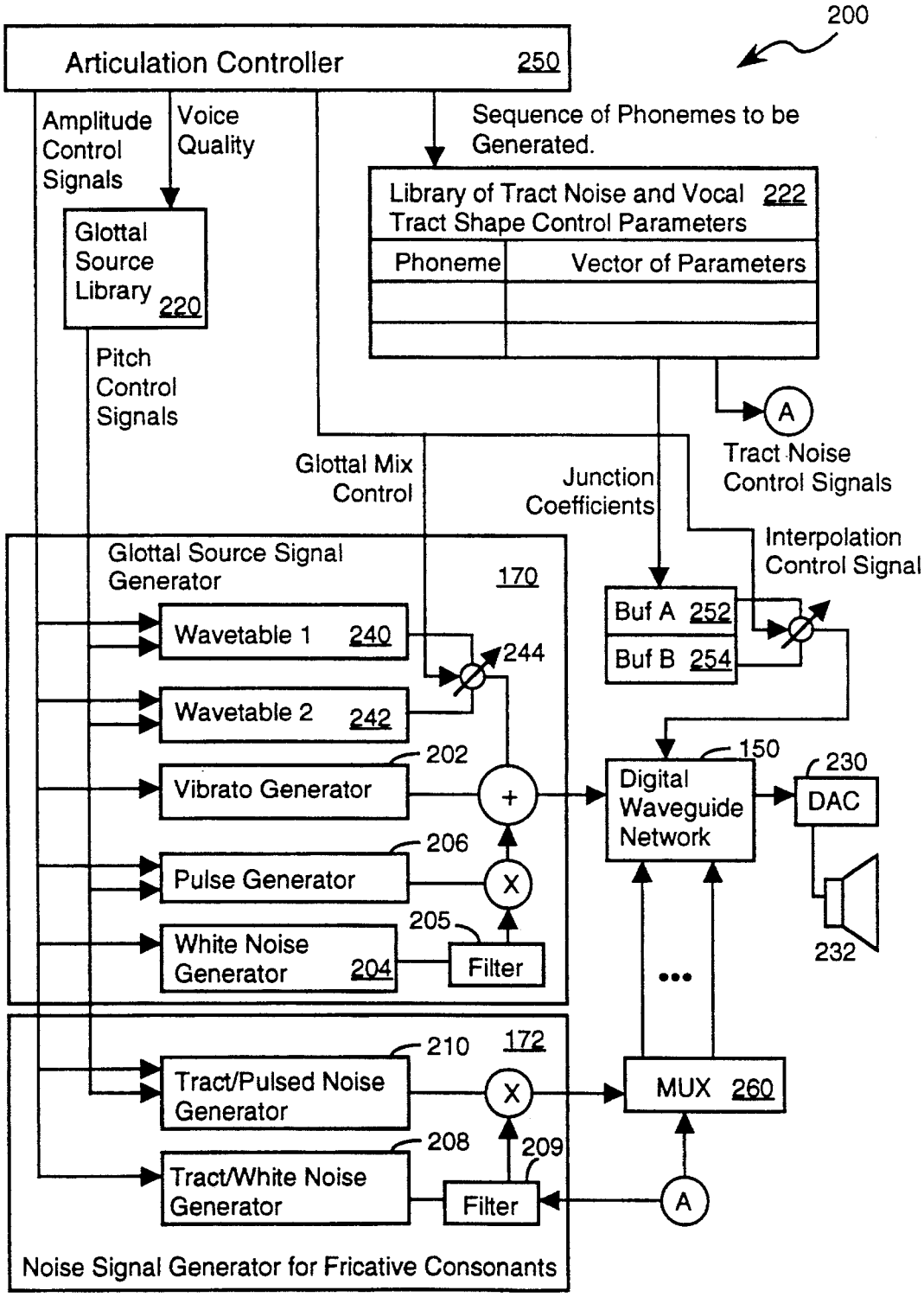
FIG. 6 represents the portion of a speech synthesizer which generates glottal source signals and also generates the parameters for governing a vocal tract filter comprising a set of digital waveguide filters.

Second to glottal fold oscillation, turbulence is the next most important source of sound in the vocal tract. The passage of air at sufficient velocity through an aperture causes turbulent streaming, and thus noise is generated. Referring to FIG. 6, in the preferred embodiment of a speech synthesizer 200, production of noise associated with the glottis is modelled by a vibrato generator 202, a white noise generator 204, filter 205 and a pulse generator 206 for pulsing the output of the white noise generator 206. Filter 205, which is preferrably a four pole filter, is used to color the noise to match the frequency spectrum found in human speakers. The frequency of the noise signal components associated with turbulent streaming can be computed analytically using well known techniques as a function of particle velocity and aperture diameter.

Noise Sources for Fricative Consonants

For most fricative consonants, a regions of the vocal tract is constricted, with air blowing through the constriction causing a turbulent jet to form and the jet radiating sound energy. The location of the constriction is different for different fricative consonants. For example, /f/ as in "fat", /s/ as in "sit", and /ʃ/ as in "shin" all have somewhat different constrictions located at or near the lips, while the /x/ in Bach is located in the oropharynx near the velum.

In the present invention, using a set of digital waveguides to synthesize speech, a set of noise signal sources 172 is provided for generating the excitation signals needed for producing fricative consonants. The noise signals are injected into the vocal tract waveguide 150 at the location corresponding to the vocal tract constriction. Thus, any spectral properties of the consonant due to linear tube acoustics are modeled automatically by the acoustic tube simulation filter (i.e., the digital waveguide network 150). Spectral properties due to turbulence can be modeled by adding an additional low-order resonant filter to the digital waveguide synthesizer.

In the preferred embodiment, the noise signals for producing fricative consonants are generated by a white noise generator 208, filter 209, and a pulse generator 210 for pulsing the filtered output of the noise generator 208. Filter 209, which is preferrably a four pole filter, is used to color the noise to match the frequency spectrum found in human speakers.

Speech Synthesizer / Articulation Controller

Referring to FIG. 6, the speech synthesizer 200 in the preferred embodiment includes a library 220 of control parameters which are downloaded into the glottal source signal generator 170, another library of vocal tract and noise signal injection control parameters 222, noise signal generator 172, and digital waveguide network 150, all of which work together to produce a specified stream of speech signals at the output of the digital waveguide network. Those speech signals are then converted by a digital to analog converter 230 into analog signals which are transmitted directly or indirectly to a speaker 232 so as to produce synthesized speech sounds.

Libary 220 contains the parameters needed to generate glottal source wavetables for a variety of different speech qualities, such as normal speech by a male person, normal speech by a female persion, baritone voice, the tone used at the end of questions, whispering, and so on.

The library 222 can be organized by phonemes or diphones or any other set of speech components that will be concatenated to generate synthesized speech. For the purposes of this description, it is assumed that the library 222 has a set of control parameters for each phoneme. For example, the number of phonemes used to parse American English is typically about 57, including 23 vowel phonemes, 33 consonant phonemes and 1 for silence. For some phonemes the library 222 stores just one associated set of control parameters governing vocal tract shape, while for other phonemes the library 220 preferably stores a plurality of control parameter sets that must be used in sequence in order to produce the phoneme. Libraries 220 and 222 will sometimes herein be called collectively "the parameter library".

An important aspect of high quality synthesized speech production is smooth transitions of the vocal tract shape and also of the glottal source signal as synthesis progresses from one speech sound to the next. In the preferred embodiment the glottal source signal generator 170 has two wavetables 240 and 242. During speech synthesis, new glottal pulse waveforms are dynamically loaded into alternating ones of these two wavetables as the synthesizer changes the quality of the synthesized voice, such as for the rising frequency used at the end of a question. In the preferred embodiment, the library 220 stores only the Fourier coefficients for the glottal pulses, and the actual pulse waveform needs to be dynamically reconstructed and loaded into the wavetables. As the speech sound being made transitions from one voice quality to the next, there is a transition period in which waveform data is read from both wavetables and then interpolated using a gradually changing mix ratio, under the control of glottal mix control signals from the synthesizer's articulation controller 250. As a result, the glottal source signal has smooth transitions from one speech sound to the next.

Interpolation is also used for smoothly varying the vocal tract shape parameters loaded into the digital waveguide network 150. In one preferred embodiment two buffers 252 and 254 are used to temporarily store the current and next sets of junction reflection coefficients for the digital waveguide network. During speech synthesis, new coefficients are dynamically loaded into alternating ones of these two buffers as the synthesizer progresses from one phoneme to the next. As the speech sound being synthesized transitions from one sound to the next, the synthesizer smoothly transitions from one vocal tract shape to the next by reading data from both buffers, summing the two sets of coefficients using a gradually changing mix ratio under the control of an interpolation control signal from the synthesizer's articulation controller 250, and loading the resulting reflection coefficients into the digital waveguide network 150. As a result, the digital waveguide network smoothly transitions from one speech sound to the next.

In an alternate vocal tract interpolation technique, buffers A and B 252, 254 are not needed. In this embodiment, the library 222 stores vocal tract section radii values for each speech sound, instead of storing reflection coefficient values. The radii values are read in by the articulation controller 250 as needed, converted into reflection coefficient values for the digital waveguide network by the articulation controller 250, and then loaded into the digital waveguide network 150. In addition, the radii of the vocal tract sections simulated by the digital waveguide network 150 are smoothly interpolated from one position to the next by the articulation controller 250, and each time the vocal tract radii are updated during the interpolation process, the corresponding waveguide reflection coefficients are recalculated by the articulation controller 250 and loaded into the digital waveguide network 150.

The articulation controller 250 controls the overall process by which sequences of selected control parameter sets are used to generate a specified sequence of speech signals. A large part of the articulation control process is handled by looking up control parameters in the library 220–222 and then loading those values, or values computed based on the parameters read from the library, into the corresponding speech synthesizer components. The retrieved control parameters in the library 220 are used in the glottal and noise signal generators to control the pitch or frequency of the signals generated. The control parameters retrieved from the library 222 include an injection point control signal that governs where in the vocal tract noise is injected for producing fricative consonants, as represented by multiplexer 260 in FIG. 6, as well as the corresponding noise coloring filter parameters that are loaded into the tract noise filter 209.

The articulation controller 250 also generates amplitude control signals which specify the amplitude of the various signal components generated by the glottal and noise signal generators 170, 172, and glottal mix and vocal tract interpolation control signals for smoothing transitions during speech generation.

In the preferred embodiment, the digital waveguide network 150 as well as the glottal source and noise signal generators 170, 172 are implemented using a digital signal processor such as the 56001 made by Motorola. The articulation controller 250, library 220 and buffers 252,254 are implemented in the preferred embodiment using a programmed microprocessor such as the 68000 made by Motorola. If the speech synthesizer 200 is to be used for text to speech conversion, prior art software known to those skilled in the art could be used for parsing the text into phonemes, handling prosodics, and so on, with the actual speech signal generation techniques of the prior art being replaced with those of the present invention.

Identification of Filter and Glottal and Other Source Control Parameters

An important and difficult aspect of the process of collecting the parameters needed to control the vocal tract filter and the glottal source is to separate the source from the filter. In other words, parameters are collected by measuring one or more human subject to determine the parameters required to synthesize similar speech signals, and it is difficult in that context to separate out which phenomena are associated with the glottal source signal and which are associated with the vocal tract. Presented next are methodologies known to the inventor for generating a library of vocal tract filter and glottal source parameters. Other methodologies may also be used.

As mentioned above, the shape of a human pharynx can be determined using X-ray and fast MIR imaging techniques while a person is speaking. Once the pharynx shape associated with any particular speech sound, such as a selected phoneme, has been identified, the junction scattering coefficients for the digital waveguide network can be computed using the scattering relation equations described above and the scattering junction model of FIG. 4B.

Once a reliable estimate of the digital network's scattering coefficients have been determined, the shape and frequency components of the glottal signal can be estimated by applying a technique known as inverse filtering, or deconvolution. The process of inverse filtering in actual practice is often part science and part art. The inverse filtering problem is simplified when pressure gradient measurements performed very near the glottal folds are used.

One inverse filtering technique used by the inventor involves using linear predictive coding (LPC) to fit the spectra of multiple signals made by a single singer or speaker using a single vocal tract shape. For example, a person phonates a selected vowel at a particular pitch and volume, and then, taking care not to change his/her vocal tract shape, the person then produces whispered speech and possible also phonates in a glottal fry mode (extremely low frequency glottal pulses). LPC analysis is then used on the various output sounds generated so as to produce a vocal tract transfer function consistent with all of the sounds generated from the same vocal tract shape. Then the inverse of that transfer function is applied to the normally phonated vowel sound to generate an estimated glottal waveform. This inverse filtering process can be repeated for all the vowel phonemes, thereby generating a reliable time domain set of glottal waveforms. The Fourier coefficients for these glottal waveforms are then mathematically determined and stored in the library 220 of control parameters.

A number of glottal source "deviations" include vibrato, which is the intentional or unintentional sinusoidal modulation of the fundamental pitch, typically at a frequency in the range of four to eight hertz. Higher frequency modulation components are typically called jitter or flutter. Vibrato frequency and amplitude can be measured using either Fourier analysis or pitch tracking techniques for tracking the frequency of a quasi-periodic signal. Other glottal source deviations include pulsed noise, associated with the quasi-periodic oscillations of the glottis exhibiting small period-to-period deviations in the waveform, caused possibly by turbulent streaming of air through the glottal folds. Pulsed noise is experiences primarily at phonation frequencies below 200 Hz, which is located within the vocal range.

Non-periodic noise components of the glottal signal can be extracted using a number of signal processing techniques, including subtraction of all periodic and otherwise predictable aspects of the glottal signal. These techniques can be used in the context of the present invention primarily to analyze (and thus derive control parameters for) the injected noise excitation signals needed for producing fricative consonants, as discussed above.

Once a complete collection of glottal signal, noise injection, and digital waveguide network control parameters is stored in the speech parameter library 220, 222, speech synthesis is accomplished by varying over time the digital waveguides so as to mimic the vocal tract shape associated with the speech sounds to be synthesized, and also to vary the glottal and noise source parameters so as to produce the excitation signals associated with the speech sounds to be synthesized. In addition, the glottal and vocal tract control parameters are smoothly interpolated between sample points to provide smooth transitions in the synthesized speech. In other words, the synthesizer accomplishes speech synthesis using the digital waveguide filter of FIG. 5 by providing excitation signals at the proper point or points in the filter and by varying the simulated vocal tract shape, thereby simulating human speech production.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A speech synthesizer, comprising:

a digital waveguide network having a first end and a second end; said digital waveguide network including a set of waveguide sections connected in series by junctions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction; wherein said digital delay lines in all of said digital waveguide sections are identical length delay lines;

a glottal signal source, coupled to said first end of said digital waveguide network, which provides excitation signals to said digital waveguide network, said excitation signals representing time-domain and frequency-domain performance of said glottal signal source;

a filter coupled to said second end of said digital waveguide network which filters signals received at said second end of said digital waveguide network so as to generate synthesized output speech signals, said filter modeling lip filtering effects;

parameter storage for storing sets of control parameters associated with corresponding sets of predefined speech signals, each set of control parameters including waveguide junction control parameters for each said junction in said digital waveguide network and glottal signal source parameters which govern the excitation signals produced by said glottal signal source; wherein said waveguide junction control parameters in each said set of control parameters cause said digital waveguide network to simulate operation of an acoustic tube with a shape corresponding to at least a human pharynx while producing sounds corresponding to one of said predefined speech signals; and articulation control means for operating said glottal signal source and said digital waveguide network using a sequence of selected sets of said control parameters, wherein said sequence of selected control parameter sets corresponds to a specified sequence of said predefined speech signals;

said digital waveguide network including three network branches coupled together by a three-way junction, a first one of said network branches terminating at said first end, a second one of said network branches terminating at said second end, and a third one of said network branches terminating at a third end;

wherein said first network branch simulates operation of a human pharynx between its vocal folds and its velum on acoustic signals, said second network branch simulates operation of a human oropharynx on acoustic signals, said third network branch simulates operation of a human nasopharynx on acoustic signals, and said three-way junction simulates the scattering at said velum of acoustic signals incident on said velum in said human pharynx, oropharynx and nasopharynx whenever said speech synthesizer is generating output speech signals, said scattering comprising transmission and reflection, transmission involving propagation of an acoustic signal from one of said branches into others of said branches, said transmission and reflection being determined by three time-varying values.

2. A speech synthesizer, comprising:

a digital waveguide network having a first end and a second end; said digital waveguide network including a set of waveguide sections connected in series by junctions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction; wherein said digital delay lines in all of said digital waveguide sections are identical length delay lines;

a glottal signal source, coupled to said first end of said digital waveguide network, which provides excitation signals to said digital waveguide network, said excitation signals representing time-domain and frequency-domain performance of said glottal signal source;

a filter coupled to said second end of said digital waveguide network which filters signals received at said second end of said digital waveguide network so as to generate synthesized output speech signals, said filter modeling lip filtering effects;

parameter storage for storing sets of control parameters associated with corresponding sets of predefined speech signals, each set of control parameters including waveguide junction control parameters for each said junction in said digital waveguide network and glottal signal source parameters which govern the excitation signals produced by said glottal signal source; wherein said waveguide junction control parameters in each said set of control parameters cause said digital waveguide network to simulate operation of an acoustic tube with a shape corresponding to at least a human pharynx while producing sounds corresponding to one of said predefined speech signals; and articulation control means for operating said glottal signal source and said digital waveguide network using a sequence of selected sets of said control parameters, wherein said sequence of selected control parameter sets corresponds to a specified sequence of said predefined speech signals; and a digital waveguide circuit including a low pass filer connected in series with a plurality of delay elements, one end of said digital waveguide circuit being coupled to said first end of said digital waveguide network for generating additional output signals corresponding to radiation of sound through a human throat wall; said synthesized output speech signals and said additional output signals together modeling human speech.

3. A speech synthesizer, comprising:

a digital waveguide network having a first end and a second end; said digital waveguide network including a set of waveguide sections connected in series by junctions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction; wherein said digital delay lines in all of said digital waveguide sections are identical length delay lines;

a glottal signal source, coupled to said first end of said digital waveguide network, which provides excitation signals to said digital waveguide network, said excitation signals representing time-domain and frequency-domain performance of said glottal signal source;

parameter storage for storing sets of control parameters associated with corresponding sets of predefined speech signals, each set of control parameters including waveguide junction control parameters for each said junction in said digital waveguide network and glottal signal source parameters which govern the excitation signals produced by said glottal signal source; wherein said waveguide junction control parameters in each said set of control parameters cause said digital waveguide network to simulate operation of an acoustic tube with a shape corresponding to at least a human pharynx while producing sounds corresponding to one of said predefined speech signals; and articulation control means for operating said glottal signal source and said digital waveguide network using a sequence of selected sets of said control parameters, wherein said sequence of selected control parameter sets corresponds to a specified sequence of said predefined speech signals;

said digital waveguide network including three network branches coupled together by a three-way junction, a first one of said network branches terminating at said first end, a second one of said network branches terminating at said second end, and a third one of said network branches terminating at a third end;

wherein said first network branch simulates operation of a human pharynx between its vocal folds and its velum on acoustic signals, said second network branch simulates operation of a human oropharynx on acoustic signals, said third network branch simulates operation of a human nasopharynx on acoustic signals, and said three-way junction simulates the scattering at said velum of acoustic signals incident on said velum in said human pharynx, oropharynx and nasopharynx whenever said speech synthesizer is generating output speech signals, said scattering comprising transmission and reflection, transmission involving propagation of an acoustic signal from one of said branches into others of said branches, said transmission and reflection being determined by three time-varying values.

4. The speech synthesizer of claim 3, said sets of control parameters including reflection and propagation coefficient values for each of said junctions; said articulation control means including interpolation means for dynamically varying said reflection and propagation coefficients so as to transition programmable reflection and propagation coefficients between said reflection and propagation coefficient values in each of said sets of control parameters.

5. The speech synthesizer of claim 3, further including:

a filter which filters signals received at said second end of said digital waveguide network so as to generate synthesized output speech signals, said filter modeling lip filtering effects.

6. A method of synthesizing speech, the steps of the method comprising:

storing in a computer memory sets of control parameters associated with corresponding sets of predefined speech signals, each set of control parameters including glottal signal source parameters which specify glottal excitation signals for synthesizing one of said predefined speech signals, and waveguide control parameters specifying how to filter said glottal excitation signals when synthesizing said one of said predefined speech signals;

generating, based on said glottal signal source parameters, time varying glottal excitation signals, said excitation signals representing time-domain and frequency-domain performance of a glottal signal source;

filtering said glottal excitation signals with a digital waveguide network that simulates how a human pharynx filters acoustic signals propagating therethrough; said digital waveguide network having a first end at which said excitation signals are input and a second end at which synthesized speech signals are output; said digital waveguide network including a set of waveguide sections connected in series by junctions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction; wherein said digital delay lines in all of said digital waveguide sections are identical length delay lines;

said filtering step including filtering said glottal excitation signals with a digital waveguide network having three network branches coupled together by a three-way junction, a first one of said network branches terminating at said first end, a second one of said network branches terminating at said second end, and a third one of said network branches terminating at a third end, said first network branch simulating operation of a human pharynx between its vocal folds and its velum on acoustic signals, said second network branch simulating operation of a human oropharynx on acoustic signals, said third network branch simulating operation of a human nasopharynx on acoustic signals, and said three-way junction simulates the scattering at said velum of acoustic signals incident on said velum in said human pharynx, oropharynx and nasopharynx whenever said speech synthesizer is generating output speech signals, said scattering comprising transmission and reflection, transmission involving propagation of an acoustic signal from one of said branches into others of said branches, said transmission and reflection being determined by three time-varying values; and operating said glottal signal source and said digital waveguide network using a sequence of selected sets of said stored control parameters, wherein said sequence of selected control parameter sets corresponds to a specified sequence of said predefined speech signals;

wherein each said set of control parameters causes said digital waveguide network to simulate operation of an acoustic tube with a shape corresponding to at least a human pharynx while producing sounds corresponding to one of said predefined speech signals.

7. The speech synthesis method of claim 6, further including low pass filtering said glottal excitation signals so as to generate additional output signals corresponding to radiation of sound through a human throat wall, said low pass filtering being implemented in a digital waveguide circuit including a low pass filter connected in series with a plurality of delay elements, one end of said digital waveguide circuit being coupled to said first end of said digital waveguide network; said synthesized output speech signals and said additional output signals together modeling human speech.

8. The speech synthesis method of claim 6, said sets of control parameters including reflection and propagation coefficient values for each of said junctions; said operating step including dynamically varying said reflection and propagation coefficients so as to transition said programmable reflection and propagation coefficients between said reflection and propagation coefficient values in each of said sets of control parameters.

9. The speech synthesis method of claim 6, further including:

filtering said synthesized speech signals at said second end to model lip filtering effects.

10. The method of claim 6, said operating step including propagating pressure and velocity signals through said waveguide sections of said digital waveguide network, said digital waveguide network's junctions reflecting and propagating said pressure and velocity signals in accordance with the equations:

$$P_m^- = k_m P_m^+ + (1 - k_m) P_{m+1}^-$$

$$P_{m+1}^+ = (1 + k_m) P_m^+ - k_m P_{m+1}^-$$

$$U_m^- = k_m U_m^+ + (1 - k_m) U_{m+1}^-$$

$$U_{m+1}^+ = (1 - k_m) U_m^+ - k_m U_{m+1}^-$$

where $k_m$ is the junction scattering coefficient for the junction between mth and m+1th sections of said digital waveguide network, $P^-_m$ represents one said pressure signal in said mth digital waveguide section moving away from said junction between said mth and m+1th digital waveguide sections, $P^+_m$ represents one said pressure signal in said mth digital waveguide section moving toward said junction between said mth and m+1th digital waveguide sections, $U^-_m$ represents one said velocity signal in said mth digital waveguide section moving away from said junction between said mth and m+1th digital waveguide sections, and $U^+_m$ represents one said velocity signal in said mth digital waveguide section moving toward said junction between said mth and m+1th digital waveguide sections.

11. A speech synthesizer, comprising:

a digital waveguide network having a first end and a second end; said digital waveguide network including a set of waveguide sections connected in series by junctions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction;

a glottal signal source, coupled to said first end of said digital waveguide network, which provides excitation signals to said digital waveguide network, said excitation signals representing time-domain and frequency-domain performance of said glottal signal source;

parameter storage for storing sets of control parameters associated with corresponding sets of predefined speech signals, each set of control parameters including waveguide junction control parameters for each said junction in said digital waveguide network and glottal signal source parameters which govern the excitation signals produced by said glottal signal source; wherein said waveguide junction control parameters in each said set of control parameters cause said digital waveguide network to simulate operation of an acoustic tube with a shape corresponding to at least a human pharynx while producing sounds corresponding to one of said predefined speech signals;

a digital waveguide circuit including a low pass filer connected in series with a plurality of delay elements, one end of said digital waveguide circuit being coupled to said first end of to said digital waveguide network for generating additional output signals corresponding to radiation of sound through a human throat wall; said synthesized output speech signals and said additional output signals together modeling human speech; and articulation control means for operating said glottal signal source and said digital waveguide network using a sequence of selected sets of said control parameters, wherein said sequence of selected control parameter sets corresponds to a specified sequence of said predefined speech signals;

wherein said digital waveguide network propagates pressure and velocity signals in each of said waveguide sections and said junctions reflect and propagate said pressure and velocity signals in accordance with the equations:

$$P_m^- = k_m P_m^+ + (1 - k_m) P_{m+1}^-$$

$$P_{m+1}^+ = (1 + k_m) P_m^+ - k_m P_{m+1}^-$$

$$U_m^- = k_m U_m^+ + (1 - k_m) U_{m+1}^-$$

$$U_{m+1}^+ = (1 - k_m) U_m^+ - k_m U_{m+1}^-$$

where $k_m$ is the junction scattering coefficient for the junction between mth and m+1th sections of said digital waveguide network, $P^-_m$ represents one said pressure signal in said mth digital waveguide section moving away from said junction between said mth and m+1th digital waveguide sections, $P^+_m$ represents one said pressure signals in said mth digital waveguide section moving toward said junction between said mth and m+1th digital waveguide sections, $U^-_m$ represents one said velocity signal in said mth digital waveguide section moving away from said junction between said mth and m+1th digital waveguide sections, and $U^+_m$ represents one said velocity signal in said mth digital waveguide section moving toward said junction between said mth and m+1th digital waveguide sections.

12. The speech synthesizer of claim 11, further including:

a filter that filters signals received at said second end of said digital waveguide network so as to generate synthesized output speech signals, said filter modeling lip filtering effects.

13. A speech synthesizer, comprising:

a digital waveguide network having a first end and a second end; said digital waveguide network including a set of waveguide sections connected in series by junctions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction;

a glottal signal source, coupled to said first end of said digital waveguide network, which provides excitation signals to said digital waveguide network, said excitation signals representing time-domain and frequency-domain performance of said glottal signal source;

a filter coupled to said second end of said digital waveguide network which filters signals received at said second end of said digital waveguide network so as to generate synthesized output speech signals, said filter modeling lip filtering effects;

parameter storage for storing sets of control parameters associated with corresponding sets of predefined speech signals, each set of control parameters including waveguide junction control parameters for each said junction in said digital waveguide network and glottal signal source parameters which govern the excitation signals produced by said glottal signal source; wherein said waveguide junction control parameters in each said set of control parameters cause said digital waveguide network to simulate operation of an acoustic tube with a shape corresponding to at least a human pharynx while producing sounds corresponding to one of said predefined speech signals; and articulation control means for operating said glottal signal source and said digital waveguide network using a sequence of selected sets of said control parameters, wherein said sequence of selected control parameter sets corresponds to a specified sequence of said predefined speech signals;

wherein said digital waveguide network propagates pressure and velocity signals in each of said waveguide sections and said junctions reflect and propagate said pressure and velocity signals in accordance with the equations:

where $k_m$ is the junction scattering coefficient for the junction between mth and m+1th sections of said digital waveguide network, $P^-_m$ represents one said pressure signal in said mth digital waveguide section moving away from said junction between said mth $$P_m^- = k_m P_m^+ + (1 - k_m) P_{m+1}^-$$

$$P_{m+1}^+ = (1 + k_m) P_m^+ - k_m P_{m+1}^-$$

$$U_m^- = k_m U_m^+ + (1 - k_m) U_{m+1}^-$$

$$U_{m+1}^+ = (1 - k_m) U_m^+ - k_m U_{m+1}^-$$

and m+1th digital waveguide sections, $P^+_m$ represents one said pressure signal in said mth digital waveguide section moving toward said junction between said mth and m+1th digital waveguide sections, $U^-_m$ represents one said velocity signal in said mth digital waveguide section moving away from said junction between said mth and m+1th digital waveguide sections, and $U^+_m$ represents one said velocity signal in said mth digital waveguide section moving toward said junction between said mth and m+1th digital waveguide sections;

said digital waveguide network including three network branches coupled together by a three-way junction, a first one of said network branches terminating at said first end, a second one of said network branches terminating at said second end, and a third one of said network branches terminating at a third end;

wherein said first network branch simulates operation of a human pharynx between its vocal folds and its velum on acoustic signals, said second network branch simulates operation of a human oropharynx on acoustic signals, said third network branch simulates operation of a human nasopharynx on acoustic signals, and said three-way junction simulates the scattering at said velum of acoustic signals incident on said velum set up in said human pharynx, oropharynx and nasopharynx whenever said speech synthesizer is generating output speech signals, said scattering comprising transmission and reflection, transmission involving propagation of an acoustic signal from one of said branches into others of said branches, said transmission and reflection being determined by three time-varying values.

14. A speech synthesis method, comprising:

storing in a computer memory sets of control parameters associated with corresponding sets of predefined speech signals, each set of control parameters including glottal signal source parameters which specify glottal excitation signals for synthesizing one of said predefined speech signals, and waveguide control parameters specifying how to filter said glottal excitation signals when synthesizing said one of said predefined speech signals;

generating, based on said glottal signal source parameters, time varying glottal excitation signals, said excitation signals reflecting time-domain and frequency-domain performance of said glottal signal source;

low pass filtering said glottal excitation signals so as to generate additional output signals corresponding to radiation of sound through a human throat wall, said low pass filtering being implemented in a digital waveguide circuit including a low pass filter connected in series with a plurality of delay elements, one end of said digital waveguide circuit being coupled to said first end of said digital waveguide network; said synthesized output speech signals and said additional output signals together modeling human speech;

filtering said glottal excitation signals with a digital waveguide network that simulates how a human pharynx filters acoustic signals propagating therethrough; said digital waveguide network having a first end at which said excitation signals are input and a second end at which synthesized speech signals are output; said digital waveguide network including a set of waveguide sections connected in series by junctions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction; wherein said digital delay lines in all of said digital waveguide sections are identical length delay lines; and operating said glottal signal source and said digital waveguide network using a sequence of selected sets of said stored control parameters, wherein said sequence of selected control parameter sets corresponds to a specified sequence of said predefined speech signals;

wherein each said set of control parameters causes said digital waveguide network to simulate operation of an acoustic tube with a shape corresponding to at least a human pharynx while producing sounds corresponding to one of said predefined speech signals.

15. The method of claim 14, said operating step including propagating pressure and velocity signals through said waveguide sections of said digital waveguide network, said digital waveguide network's junctions reflecting and propagating said pressure and velocity signals in accordance with the equations:

$$P_m^- = k_m P_m^+ + (1 - k_m) P_{m+1}^-$$

$$P_{m+1}^+ = (1 + k_m) P_m^+ - k_m P_{m+1}^-$$

$$U_m^- = k_m U_m^+ + (1 - k_m) U_{m+1}^-$$

$$U_{m+1}^+ = (1 - k_m) U_m^+ - k_m U_{m+1}^-$$

where $k_m$ is the junction scattering coefficient for the junction between mth and m+1th sections of said digital waveguide network, $P^-_m$ represents one said pressure signal in said mth digital waveguide section moving away from said junction between said mth and m+1th digital waveguide sections, $P^+_m$ represents one said pressure signal in said mth digital waveguide section moving toward said junction between said mth and m+1th digital waveguide sections, $U^-_m$ represents one said velocity signal in said mth digital waveguide section moving away from said junction between said mth and m+1th digital waveguide sections, and $U^+_m$ represents one said velocity signal in said mth digital waveguide section moving toward said junction between said mth and m+1th digital waveguide sections.

16. A speech synthesizer, comprising:

a digital waveguide network having a first end and a second end; said digital waveguide network including a set of waveguide sections connected in series by junctions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction; wherein said digital delay lines in all of said digital waveguide sections are identical length delay lines;

a glottal signal source, coupled to said first end of said digital waveguide network, which provides excitation signals to said digital waveguide network, said excitation signals representing time-domain and frequency-domain performance of said glottal signal source;

parameter storage for storing sets of control parameters associated with corresponding sets of predefined speech signals, each set of control parameters including waveguide junction control parameters for each said junction in said digital waveguide network and glottal signal source parameters which govern the excitation signals produced by said glottal signal source; wherein said waveguide junction control parameters in each said set of control parameters cause said digital waveguide network to simulate operation of an acoustic tube with a shape corresponding to at least a human pharynx while producing sounds corresponding to one of said predefined speech signals;

articulation control means for operating said glottal signal source and said digital waveguide network using a sequence of selected sets of said control parameters, wherein said sequence of selected control parameter sets corresponds to a specified sequence of said predefined speech signals; and a digital waveguide circuit including a low pass filer connected in series with a plurality of delay elements, one end of said digital waveguide circuit being coupled to said first end of said digital waveguide network for generating additional output signals corresponding to radiation of sound through a human throat wall; said synthesized output speech signals and said additional output signals together modeling human speech.

* * * * *